US006848508B2

(12) United States Patent
Zupanick

(10) Patent No.: US 6,848,508 B2
(45) Date of Patent: Feb. 1, 2005

(54) SLANT ENTRY WELL SYSTEM AND METHOD

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 0 days.

(21) Appl. No.: 10/749,884

(22) Filed: Dec. 31, 2003

(65) Prior Publication Data

US 2004/0154802 A1 Aug. 12, 2004

Related U.S. Application Data

(62) Division of application No. 10/004,316, filed on Oct. 30, 2001.

(51) Int. Cl.[7] ..... E21B 43/14; E21B 7/08

(52) U.S. Cl. ..... 166/313; 166/52; 175/80

(58) Field of Search ..... 166/313, 380, 166/52, 117.6; 175/79, 80, 81, 82; 239/33, 17, DIG. 12, 587.1, 548

(56) References Cited

U.S. PATENT DOCUMENTS

| | | | | |
|---|---|---|---|---|
| 54,144 | A | 4/1866 | Hamar | |
| 274,740 | A | 3/1883 | Douglass | |
| 526,708 | A | 10/1894 | Horton | |
| 639,036 | A | 12/1899 | Heald | |
| 1,189,560 | A | 7/1916 | Gondos | |
| 1,285,347 | A | 11/1918 | Otto | |
| 1,467,480 | A | 9/1923 | Hogue | |
| 1,485,615 | A | 3/1924 | Jones | |
| 1,488,106 | A | 3/1924 | Fitzpatrick | |
| 1,520,737 | A | 12/1924 | Wright | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Boll et al. | 255/24 |
| 2,335,085 | A | 11/1943 | Roberts | 251/197 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,726,063 | A | 12/1955 | Ragland et al. | 255/1.8 |
| 2,726,847 | A | 12/1955 | McCune et al. | 255/1.6 |

(List continued on next page.)

FOREIGN PATENT DOCUMENTS

| | | | |
|---|---|---|---|
| CA | 2 278 735 | 1/1998 | E21C/21/24 |
| CH | 653 741 | 1/1986 | E21B/43/24 |

(List continued on next page.)

OTHER PUBLICATIONS

Notification of Transmittal of the International Search Report or the Declaration (PCT Rule 44.1) mailed Feb. 9, 2004 (6 pages) re International Application No. PCT/US 03/28138, Sep. 9, 2003.

(List continued on next page.)

*Primary Examiner*—David Bagnell
*Assistant Examiner*—Daniel P Stephenson
(74) *Attorney, Agent, or Firm*—Fish & Richardson P.C.

(57) ABSTRACT

A guide tube bundle includes two or more guide tubes. Each guide tube includes a first aperture at a first end and a second aperture at a second end. The longitudinal axis of the first aperture of each guide tube is offset from the longitudinal axis of the second aperture of the guide tube Furthermore, the guide tubes are configured longitudinally adjacent to each other and are twisted around one another.

7 Claims, 7 Drawing Sheets

U.S. PATENT DOCUMENTS

| | | | | |
|---|---|---|---|---|
| 2,783,018 | A | 2/1957 | Lytle | 251/25 |
| 2,847,189 | A | 8/1958 | Shook | 255/76 |
| 2,911,008 | A | 11/1959 | Du Bois | 137/625.31 |
| 2,980,142 | A | 4/1961 | Turak | 137/637.3 |
| 3,347,595 | A | 10/1967 | Dahms et al. | 299/4 |
| 3,443,648 | A | 5/1969 | Howard | 175/103 |
| 3,473,571 | A | 10/1969 | Dugay | 137/625.4 |
| 3,503,377 | A | 3/1970 | Beatenbough et al. | 123/117 |
| 3,528,516 | A | 9/1970 | Brown | 175/267 |
| 3,530,675 | A | 9/1970 | Turzillo | 61/35 |
| 3,684,041 | A | 8/1972 | Kammerer, Jr. et al. | 175/267 |
| 3,692,041 | A | 9/1972 | Bondi | 137/238 |
| 3,757,876 | A | 9/1973 | Pereau | 175/267 |
| 3,757,877 | A | 9/1973 | Leathers | 175/269 |
| 3,800,830 | A | 4/1974 | Etter | 137/625.41 |
| 3,809,519 | A | 5/1974 | Garner | 425/245 |
| 3,825,081 | A | 7/1974 | McMahon | 175/73 |
| 3,828,867 | A | 8/1974 | Elwood | 175/45 |
| 3,874,413 | A | 4/1975 | Valdez | 137/625.47 |
| 3,887,008 | A | 6/1975 | Canfield | 166/267 |
| 3,902,322 | A | 9/1975 | Watanabe | 61/35 |
| 3,907,045 | A | 9/1975 | Dahl et al. | 175/45 |
| 3,934,649 | A | 1/1976 | Pasini, III et al. | 166/254 |
| 3,957,082 | A | 5/1976 | Fuson et al. | 137/625.41 |
| 3,961,824 | A | 6/1976 | Van Eek et al. | 299/17 |
| 4,011,890 | A | 3/1977 | Andersson | 137/625.4 |
| 4,022,279 | A | 5/1977 | Driver | 166/271 |
| 4,030,310 | A | 6/1977 | Schirtzinger | 61/86 |
| 4,037,658 | A | 7/1977 | Anderson | 166/272 |
| 4,073,351 | A | 2/1978 | Baum | 175/14 |
| 4,089,374 | A | 5/1978 | Terry | 166/259 |
| 4,116,012 | A | 9/1978 | Abe et al. | 405/238 |
| 4,136,996 | A | 1/1979 | Burns | 405/195 |
| 4,156,437 | A | 5/1979 | Chivens et al. | 137/554 |
| 4,169,510 | A | 10/1979 | Meigs | 175/65 |
| 4,189,184 | A | 2/1980 | Green | 299/8 |
| 4,220,203 | A | 9/1980 | Steeman | 166/271 |
| 4,221,433 | A | 9/1980 | Jacoby | 299/4 |
| 4,257,650 | A | 3/1981 | Allen | 299/2 |
| 4,278,137 | A | 7/1981 | Van Eek | 175/267 |
| 4,283,088 | A | 8/1981 | Tabakov et al. | 299/2 |
| 4,296,785 | A | 10/1981 | Vitello et al. | 141/105 |
| 4,299,295 | A | 11/1981 | Gossard | 175/45 |
| 4,303,127 | A | 12/1981 | Freel et al. | 166/266 |
| 4,305,464 | A | 12/1981 | Masszi | 166/370 |
| 4,312,377 | A | 1/1982 | Knecht | 137/625.19 |
| 4,317,492 | A | 3/1982 | Summers et al. | 175/79 |
| 4,328,577 | A | 5/1982 | Abbott et al. | 370/84 |
| 4,333,539 | A | 6/1982 | Lyons et al. | 175/61 |
| 4,366,988 | A | 1/1983 | Bodine | 299/14 |
| 4,372,398 | A | 2/1983 | Kuckes | 175/45 |
| 4,386,665 | A | 6/1983 | Dellinger | 175/61 |
| 4,390,067 | A | 6/1983 | Willman | 166/245 |
| 4,396,076 | A | 8/1983 | Inoue | 175/265 |
| 4,397,360 | A | 8/1983 | Schmidt | 175/61 |
| 4,401,171 | A | 8/1983 | Fuchs | 175/267 |
| 4,407,376 | A | 10/1983 | Inoue | 175/267 |
| 4,437,706 | A | 3/1984 | Johnson | 299/7 |
| 4,442,896 | A | 4/1984 | Reale et al. | 166/278 |
| 4,494,616 | A | 1/1985 | McKee | 175/67 |
| 4,512,422 | A | 4/1985 | Knisley | 175/99 |
| 4,519,463 | A | 5/1985 | Schuh | 175/61 |
| 4,527,639 | A | 7/1985 | Dickinson, III et al. | 175/61 |
| 4,532,986 | A | 8/1985 | Mims et al. | 166/50 |
| 4,544,037 | A | 10/1985 | Terry | 166/369 |
| 4,558,744 | A | 12/1985 | Gibb | 166/335 |
| 4,565,252 | A | 1/1986 | Campbell et al. | 175/269 |
| 4,573,541 | A | 3/1986 | Josse et al. | 175/78 |
| 4,599,172 | A | 7/1986 | Gardes | 210/314 |
| 4,600,061 | A | 7/1986 | Richards | 175/62 |
| 4,605,076 | A | 8/1986 | Goodhart | 175/61 |
| 4,611,855 | A | 9/1986 | Richards | 299/2 |
| 4,618,009 | A | 10/1986 | Carter et al. | 175/267 |
| 4,638,949 | A | 1/1987 | Mancel | 239/307 |
| 4,646,836 | A | 3/1987 | Goodhart | 166/303 |
| 4,674,579 | A | 6/1987 | Geller et al. | 175/45 |
| 4,702,314 | A | 10/1987 | Huang et al. | 166/245 |
| 4,705,431 | A | 11/1987 | Gadelle et al. | 405/267 |
| 4,715,440 | A | 12/1987 | Boxell et al. | 166/100 |
| 4,754,819 | A | 7/1988 | Dellinger | 175/61 |
| 4,756,367 | A | 7/1988 | Puri et al. | 166/263 |
| 4,763,734 | A | 8/1988 | Dickinson et al. | 175/61 |
| 4,773,488 | A | 9/1988 | Bell et al. | 175/61 |
| 4,830,105 | A | 5/1989 | Petermann | 166/241 |
| 4,836,611 | A | 6/1989 | El-Saie | 299/7 |
| 4,842,081 | A | 6/1989 | Parant | 175/23 |
| 4,844,182 | A | 7/1989 | Tolle | 175/215 |
| 4,852,666 | A | 8/1989 | Brunet et al. | 175/61 |
| 4,883,122 | A | 11/1989 | Puri et al. | 166/248 |
| 4,978,172 | A | 12/1990 | Schwoebel et al. | 299/12 |
| 5,016,710 | A | 5/1991 | Renard et al. | 166/245 |
| 5,035,605 | A | 7/1991 | Dinerman et al. | 481/18 |
| 5,036,921 | A | 8/1991 | Pittard et al. | 166/298 |
| 5,074,360 | A | 12/1991 | Guinn | 166/281 |
| 5,074,365 | A | 12/1991 | Kuckes | 175/40 |
| 5,074,366 | A | 12/1991 | Karlsson et al. | 175/76 |
| 5,082,054 | A | 1/1992 | Kiamanesh | 166/248 |
| 5,111,893 | A | 5/1992 | Kvello-Aune | 175/258 |
| 5,135,058 | A | 8/1992 | Millgard et al. | 175/71 |
| 5,148,875 | A | 9/1992 | Karlsson et al. | 175/62 |
| 5,148,877 | A * | 9/1992 | MacGregor | 175/79 |
| 5,165,491 | A | 11/1992 | Wilson | 175/62 |
| 5,168,942 | A | 12/1992 | Wydrinski | 175/50 |
| 5,174,374 | A | 12/1992 | Hailey | 166/55.8 |
| 5,193,620 | A | 3/1993 | Braddick | 166/382 |
| 5,194,859 | A | 3/1993 | Warren | 340/853.4 |
| 5,197,553 | A | 3/1993 | Leturno | 175/57 |
| 5,197,783 | A | 3/1993 | Theimer et al. | 299/17 |
| 5,199,496 | A | 4/1993 | Redus et al. | 166/366 |
| 5,201,817 | A | 4/1993 | Hailey | 175/269 |
| 5,217,076 | A | 6/1993 | Masek | 166/303 |
| 5,226,495 | A | 7/1993 | Jennings, Jr. | 166/278 |
| 5,240,350 | A | 8/1993 | Yamaguchi et al. | 405/143 |
| 5,242,017 | A | 9/1993 | Hailey | 166/55.8 |
| 5,242,025 | A | 9/1993 | Neill et al. | 175/26 |
| 5,246,273 | A | 9/1993 | Rosar | 299/4 |
| 5,255,741 | A | 10/1993 | Alexander | 166/278 |
| 5,271,472 | A | 12/1993 | Leturno | 175/107 |
| 5,301,760 | A | 4/1994 | Graham | 175/61 |
| 5,363,927 | A | 11/1994 | Frank | 175/67 |
| 5,385,205 | A | 1/1995 | Hailey | 166/55.8 |
| 5,394,950 | A | 3/1995 | Gardes | 175/45 |
| 5,402,851 | A | 4/1995 | Baiton | 166/369 |
| 5,411,082 | A | 5/1995 | Kennedy | 166/181 |
| 5,411,085 | A | 5/1995 | Moore et al. | 166/242 |
| 5,411,088 | A | 5/1995 | LeBlanc et al. | 166/265 |
| 5,411,104 | A | 5/1995 | Stanley | 175/65 |
| 5,411,105 | A | 5/1995 | Gray | 175/69 |
| 5,431,220 | A | 7/1995 | Lennon et al. | 166/55.7 |
| 5,435,400 | A | 7/1995 | Smith | 175/61 |
| 5,447,416 | A | 9/1995 | Wittrisch | 417/442 |
| 5,450,902 | A | 9/1995 | Matthews | 166/268 |
| 5,454,419 | A | 10/1995 | Vloedman | 166/277 |
| 5,458,209 | A | 10/1995 | Hayes et al. | 175/61 |
| 5,462,116 | A | 10/1995 | Carroll | 166/249 |
| 5,462,120 | A | 10/1995 | Gondouin | 166/380 |
| 5,469,155 | A | 11/1995 | Archambeault et al. | 340/853.4 |
| 5,477,923 | A | 12/1995 | Jordan, Jr. et al. | 66/313 |
| 5,485,089 | A | 1/1996 | Kuckes | 324/346 |
| 5,494,121 | A | 2/1996 | Nackerud | 175/263 |
| 5,499,687 | A | 3/1996 | Lee | 175/317 |

| | | | | |
|---|---|---|---|---|
| 5,501,273 | A | 3/1996 | Puri | 166/252.5 |
| 5,501,279 | A | 3/1996 | Garg et al. | 166/372 |
| 5,584,605 | A | 12/1996 | Beard et al. | 405/128 |
| 5,613,242 | A | 3/1997 | Oddo | 588/17 |
| 5,615,739 | A | 4/1997 | Dallas | 166/306 |
| 5,653,286 | A | 8/1997 | McCoy et al. | 166/105.5 |
| 5,669,444 | A | 9/1997 | Riese et al. | 166/263 |
| 5,680,901 | A | 10/1997 | Gardes | 166/313 |
| 5,690,390 | A | 11/1997 | Bithell | 299/4 |
| 5,706,871 | A | 1/1998 | Anderson et al. | 141/59 |
| 5,720,356 | A | 2/1998 | Gardes | 175/62 |
| 5,727,629 | A | 3/1998 | Blizzard, Jr. et al. | 166/298 |
| 5,735,350 | A | 4/1998 | Longbottom et al. | 166/313 |
| 5,771,976 | A | 6/1998 | Talley | 166/370 |
| 5,775,433 | A | 7/1998 | Hammett et al. | 166/98 |
| 5,785,133 | A | 7/1998 | Murray et al. | 175/61 |
| 5,832,958 | A | 11/1998 | Cheng | 137/625.41 |
| 5,853,054 | A | 12/1998 | McGarian et al. | 175/267 |
| 5,853,056 | A | 12/1998 | Landers | 175/424 |
| 5,863,283 | A | 1/1999 | Gardes | 588/250 |
| 5,868,202 | A | 2/1999 | Hsu | 166/256 |
| 5,868,210 | A | 2/1999 | Johnson et al. | 175/40 |
| 5,879,057 | A | 3/1999 | Schwoebel et al. | 299/17 |
| 5,884,704 | A | 3/1999 | Longbottom et al. | 16/313 |
| 5,917,325 | A | 6/1999 | Smith | 324/326 |
| 5,934,390 | A | 8/1999 | Uthe | 175/67 |
| 5,938,004 | A | 8/1999 | Roberts et al. | 198/812 |
| 5,957,539 | A | 9/1999 | Durup et al. | 299/4 |
| 5,971,074 | A | 10/1999 | Longbottom et al. | 166/313 |
| 6,012,520 | A | 1/2000 | Yu et al. | 166/245 |
| 6,015,012 | A | 1/2000 | Reddick | 166/313 |
| 6,024,171 | A | 2/2000 | Montgomery et al. | 166/308 |
| 6,050,335 | A | 4/2000 | Parsons | 166/272.3 |
| 6,056,059 | A | 5/2000 | Ohmer | 166/313 |
| 6,065,550 | A | 5/2000 | Gardes | 175/62 |
| 6,119,771 | A | 9/2000 | Gano et al. | 166/50 |
| 6,135,208 | A | 10/2000 | Gano et al. | 166/313 |
| 6,179,054 | B1 | 1/2001 | Stewart | 166/105.5 |
| 6,209,636 | B1 | 4/2001 | Roberts et al. | 166/117.6 |
| 6,280,000 | B1 | 8/2001 | Zupanick | 299/12 |
| 6,349,769 | B1 | 2/2002 | Ohmer | 166/313 |
| 6,357,523 | B1 | 3/2002 | Zupanick | 166/52 |
| 6,357,530 | B1 | 3/2002 | Kennedy et al. | 166/369 |
| 6,425,448 | B1 | 7/2002 | Zupanick et al. | 175/61 |
| 6,439,320 | B2 | 8/2002 | Zupanick | 166/313 |
| 6,450,256 | B2 | 9/2002 | Mones | 166/250.01 |
| 6,454,000 | B1 | 9/2002 | Zupanick | 417/243 |
| 6,457,540 | B2 | 10/2002 | Gardes | 175/62 |
| 6,478,085 | B2 | 11/2002 | Zupanick | 166/50 |
| 6,497,556 | B2 | 12/2002 | Zupanick et al. | 417/85 |
| 6,561,288 | B2 | 5/2003 | Zupanick | |
| 6,566,649 | B1 | 5/2003 | Mickael | 250/269.3 |
| 6,571,888 | B2 | 6/2003 | Comeau et al. | 175/61 |
| 6,575,235 | B2 | 6/2003 | Zupanick | |
| 6,577,129 | B1 | 6/2003 | Thompson et al. | 324/338 |
| 6,585,061 | B2 | 7/2003 | Radzinski et al. | 175/45 |
| 6,590,202 | B2 | 7/2003 | Mickael | 250/269.2 |
| 6,591,903 | B2 | 7/2003 | Ingle et al. | 166/50 |
| 6,598,686 | B1 | 7/2003 | Zupanick | 175/62 |
| 6,604,580 | B2 | 8/2003 | Zupanick | |
| 6,604,910 | B1 | 8/2003 | Zupanick | |
| 6,607,042 | B2 | 8/2003 | Hoyer et al. | 175/38 |
| 6,636,159 | B1 | 10/2003 | Winnacker | 340/854.3 |
| 6,639,210 | B2 | 10/2003 | Odom et al. | 250/269.6 |
| 6,646,441 | B2 | 11/2003 | Thompson et al. | 324/338 |
| 6,653,839 | B2 | 11/2003 | Yuratich et al. | 324/355 |
| 6,662,870 | B1 | 12/2003 | Zupanick et al. | 166/245 |
| 6,668,918 | B2 | 12/2003 | Zupanick | 166/50 |
| 6,679,322 | B1 | 1/2004 | Zupanick | 166/50 |
| 6,681,855 | B2 | 1/2004 | Zupanick et al. | 166/50 |
| 6,688,388 | B2 | 2/2004 | Zupanick | 166/50 |
| 2003/0096336 | A1 | 11/2001 | Zupanick | 175/161 |
| 2002/0050358 | A1 | 5/2002 | Algeroy et al. | 166/313 |
| 2002/0074120 | A1 | 6/2002 | Scott | 166/313 |
| 2002/0074122 | A1 | 6/2002 | Kelly et al. | 166/313 |
| 2002/0117297 | A1 | 8/2002 | Zupanick | 166/50 |
| 2002/0189801 | A1 | 12/2002 | Zupanick | 166/50 |
| 2003/0062198 | A1 | 4/2003 | Gardes | 175/61 |
| 2003/0066686 | A1 | 4/2003 | Conn | 175/57 |
| 2003/0075334 | A1 | 4/2003 | Haugen et al. | 166/313 |
| 2003/0106686 | A1 | 6/2003 | Ingle et al. | 166/245 |
| 2004/0007389 | A1 | 1/2004 | Zupanick | 175/61 |
| 2004/0007390 | A1 | 1/2004 | Zupanick | 175/61 |

FOREIGN PATENT DOCUMENTS

| | | | |
|---|---|---|---|
| EP | 0 875 661 A1 | 11/1998 | E21B/43/30 |
| EP | 0 952 300 A1 | 10/1999 | E21B/7/12 |
| FR | 964503 | 4/1944 | 8/1 |
| GB | 2 255 033 | 10/1992 | B04B/11/02 |
| GB | 2 297 988 | 8/1996 | E21B/7/08 |
| GB | 2 347 157 A | 8/2000 | E21B/43/00 |
| GB | 2347157 | 8/2002 | E21B/43/00 |
| SU | 750108 | 6/1975 | E21C/45/00 |
| SU | 1448078 A1 | 3/1987 | E21F/5/00 |
| SU | 1770570 A1 | 3/1990 | E21F/7/00 |
| WO | 94/21889 | 9/1994 | E21B/43/24 |
| WO | WO 98/35133 | 8/1998 | E21C/27/24 |
| WO | WO 99/60248 | 11/1999 | E21B/43/30 |
| WO | 00/31376 | 6/2000 | E21C/41/00 |
| WO | WO 00/79099 | 12/2000 | E21B/43/25 |
| WO | WO 01/44620 | 6/2001 | E21B/43/38 |
| WO | WO 02/18738 | 3/2002 | E21B/7/04 |
| WO | WO 02/059455 | 8/2002 | E21B/43/00 |
| WO | WO 02/061238 | 8/2002 | |
| WO | WO 03/102348 | 12/2003 | |

OTHER PUBLICATIONS

Notification of Transmittal of the International Search Report or the Declaration (PCT Rule 44.1) mailed Feb. 27, 2004 (9 pages) re International Application No. PCT/US 03/30126, Sep. 23, 2004.

Fletcher, "Anadarko Cuts Gas Route Under Canadian River Gorge," Oil and Gas Journal, pp. 28–30, Jan. 25, 2004.

Translation of selected pages of Kalinin, et al., "Drilling Inclined and Horizontal Well Bores," Nedra Publishers, Moscow, 1997, 15 pages.

Translation of selected pages of Arens, V.Zh., "Well–Drilling Recovery of Minerals," Geotechnology, Nedra Publishers, Moscow, 7 pages, 1986.

Gopal Ramaswamy, "Production History Provides CBM Insights," Oil & Gas Journal, pp. 49, 50 and 52, Apr. 2, 2001.

Weiguo Chi and Luwu Yang, "Feasibility of Coalbed Methane Exploitation in China," Horizontal Well Technology, p. 74, Sep. 2001.

Nackerud Product Description, Harvest Tool Company, LLC, 1 page, received Sep. 27, 2001.

Gopal Ramaswamy, "Advanced Key for Coalbed Methane," The American Oil & Gas Reporter, pp. 71 & 73, Oct. 2001.

Joseph C. Stevens, Horizontal Applications For Coal Bed Methane Recovery, Strategic Research Institute, pp. 1–10 (slides), Mar. 25, 2002.

R.J. "Bob" Stayton, "Horizontal Wells Boost CBM Recovery", Special Report: Horizontal & Directional Drilling, The American Oil & Gas Reporter, pp. 71–75, Aug. 2002.

Susan Eaton, "Reversal of Fortune", New Technology Magazine, pp 30–31, Sep. 2002.

James Mahony, "A Shadow of Things to Come", New Technology Magazine, pp. 28–29, Sep. 2002.

Documents Received from Third Party, Great Lakes Directional Drilling, Inc., (12 pages), received Sep. 12, 2002.
Robert W. Taylor and Richard Russell, Multilateral Technologies Increase Operational Efficiencies in Middle East, Oil & Gas Journal, pp. 76–80, Mar. 16, 1998.
Adam Pasiczynk, "Evolution Simplifies Multilateral Wells", Directional Drilling, pp. 53–55, Jun. 2000.
Steven S. Bell, "Multilateral System with Full Re–Entry Access Installed", World Oil, p. 29, Jun. 1996.
P. Jackson and S. Kershaw, Reducing Long Term Methane Emissions Resulting from Coal Mining, Energy Convers. Mgmt, vol. 37, Nos. 6–8, pp. 801–806, 1996.
Gardes, U.S. patent application Publication No. U.S. 2003/0062198 A1 "Method and System for Hydraulic Friction Controlled Drilling and Completing Geopressured Wells . . . ", Apr. 3, 2003.
Kelly et al., U.S. patent application Publication No. U.S. 2002/0074122 A1 "Method and Apparatus for Hydrocarbon Subterranean Recover", Jun. 20, 2002.
Zupanick, U.S. patent application Ser. No. 09/788,897, entitled "Method and System for Accessing Subterranean Deposits From The Surface," (067083.0138), Feb. 20, 2001.
Zupanick, U.S. patent application Ser. No. 10/046,001, entitled "Method and System for Management of By–Products From Subterranean Zones," (067083.0134), Oct. 19, 2001.
Zupanick, U.S. patent application Ser. No. 09/774,996, entitled "Method and System for Accessing a Subterranean Zone From a Limited Surface Area," (067083.0120), Jan. 30, 2001.
Howard L. Hartman, et al.; "SME Mining Engineering Handbook;" Society for Mining, Metallurgy, and Exploration, Inc.; pp 1946–1950, 2nd Edition, vol. 2, 1992.
Dave Hassan, Mike Chernichen, Earl Jensen, and Morley Frank; "Multi–lateral technique lowers drilling costs, provides environmental benefits", Drilling Technology, pp. 41–47, Oct. 1999.
Pascal Breant, "Des Puits Branches, Chez Total : les puits multi drains", Total Exploration Production, pp. 1–5, Jan. 1999.
Abstract of AU 8549964, 1987.
McCray and Cole, "Oil Well Drilling and Technology," University of Oklahoma Press, pp 315–319, 1959.
Berger and Anderson, "Modern Petroleum;" PennWell Books, pp 106–108, 1978.
Arfon H. Jones et al., A Review of the Physical and Mechanical Properties of Coal with Implications for Coal–Bed Methane Well Completion and Production, Rocky Mountain Association of Geologists, pp. 169–181, 1988.
U.S. Department of Energy, "Slant Hole Drilling", (1 page), Apr. 1999.
Notification of Transmittal of the International Search Report or the Declaration (PCT Rule 44.1) mailed Nov. 6, 2003 (8 pages) re International Application No. PCT/US 03/21626, filed Jul. 11, 2003.
Notification of Transmittal of the International Search Report or the Declaration (PCT Rule 44.1) mailed Nov. 5, 2003 (8 pages) re International Application No. PCT/US 03/21627, filed Jul. 11, 2003.
Notification of Transmittal of the International Search Report or the Declaration (PCT Rule 44.1) mailed Nov. 4, 2003 (7 pages) re International Application No. PCT/US 03/21628, filed Jul. 11, 2003.
Notification of Transmittal of the International Search Report or the Declaration (PCT Rule 44.1) mailed Dec. 5, 2003 (8 pages) re International Application No. PCT/US 03/21750, filed Jul. 11, 2003.
Examiner of Record, Office Action Response regarding the Interpretation of the three Russian Patent Applications listed above under Foreign Patent Documents (9 pages), date unknown.
Ian D. Palmer et al., "*Coalbed Methane Well Completions and Stimulations*", Chapter 14, pp. 303–339, Hydrocarbons from Coal, Published by the American Association of Petroleum Geologists, 1993.
B. Gotas et al., "*Performance of Openhole Completed and Cased Horizontal/Undulating Wells in Thin–Bedded, Tight Sand Gas Reservoirs*, " Society of Petroleum Engineers, Inc., Oct. 17 through Oct. 19, 2000, pp. 1–7.
R. Sharma, et al., "*Modelling of Undulating Wellbore Trajectories, The Journal of Canadian Petroleum Technology*", XP–002261908, Oct. 18–20, 1993, pp 16–24.
E. F. Balbinski et al., "*Prediction of Offshore Viscous Oil Field Performance*," European Symposium on Improved Oil Recovery, Aug. 18–20, 1999, pp. 1–10.
Chi, Weiguo, "*A Feasible Discussion on Exploitation Coalbed Methane through Horizontal Network Drilling in Chino*", SPE 64709, Society of Petroleum Engineers (SPE International), 4 pages.
Chi, Weiguo,"*Feasibility of Coalbed Methane Exploitation in China*", synopsis of paper SPE 64709, 1 page.
Zupanick, U.S. Patent Application Ser. No. 10/264,535, "Method and System for Removing Fluid From a Subterranean Zone Using and Enlarged Cavity".
Notification of Transmittal of the International Search Report or the Declaration (PCT Rule 44.1) mailed Dec. 19, 2003 (8 pages) re International Application No. PCT/US 03/28137.
Notification of Transmittal of the International Search Report or the Declaration (PCT Rule 44.1) mailed Feb. 4, 2004 (8 pages) re International Application No. PCT/US 03/26124.
Smith, Maurice, "*Chasing Unconventional Gas Unconventionally*", CBM Gas Technology Magazine, Oct./Nov. 2003, pp. 1–4.
Gardes, Robert "*A New Direction in Coolbed Methane and Shale Gas Recovery*" (to the best of Applicants recollection, first received at the Canadian Institute Coalbed Methane Symposium conference on Jun. 16 and Jun. 17, 2002), 1 page of conference flyer, 6 pages of document.
Gardes, Robert, "*Under–Balance Multi–Lateral Drilling for Unconventional Gas Recovery*" (to the best of Applicants' recollection, first received at the Unconventional Gas Revolution conference on Dec. 9, 2003), 4 pages of conference flyer, 33 pages of document.
Boyce, Richard "*High Resolution Selsmic Imaging Programs for Coalbed Methane Development*" (to the best of Applicants' recollection, first received at the Unconventional Gas Revolution conference on Dec. 10, 2003), 4 pages of conference flyer, 24 pages of document.
Mark Mazzella and David Strickland, "*Well Control Operations on a Multiwell Platform Blowout*" WorldOil.com – Online Magazine Article, vol. 22, Part I –pp. 1–7, and Part II –pp. 1–13.
Vector Magnetics LLC, Case History, California, May 1999, "*Successful Kill of Surface Blowout*," pp. 1–12.

Cudd Pressure Control, Inc, "*Successful Well Control Operations–A Case Study: Surface and Subsurface Well Intervention on a Multi–Well Offshore Platform Blowout and Fire*," pp. 1–17.

R. Purl, et al., "*Damage to Coal Permeability During Hydraulic Fracturing*," pp. 109–115 (SPE 21813).

U.S. Dept. of Energy –Office of Fossil Energy, "*Multi–Seam Well Completion Technology: Implications for Powder River Basin Coalbed Methane Production*, " pp. 1–1000, A–1 through A10.

U.S. Dept. of Energy –Office of Fossil Energy, "*Powder River Basin Coalbed Methane Development and Produ ced Water Managament Study*," pp. 1–1111, A–1 through A14.

Zupanick, U.S. Pat. Appl., entitled Method and System for Controlling the Production Rate . . ., SN 10/328,408.

U.S. Pat. Appl., entitled Method and System for Accessing a Subterranean Zone from a Limited Surface Area, SN 10/188,141.

Zupanick, U.S. Pat. Appl., entitled "Three–Dimensional Well System for Accessing Subterranean Deposits from the Surface and Tools Therefor," SN 10/630,345.

Zupanick, U.S. Pat. Appl., entitled "Method and System for Testing Partially Formed Hydrocarbon Well for Evaluation and Well Planning Refinement," SN —/——,——.

Zupanick, U.S. Pat. Appl., entitled "Method and System for Testing Partially Formed Hydrocarbon Well for Evaluation and Well Planning Refinement," SN 10/715,300.

Rial, U.S. Pat. Appl., entitled "Method and System for Recirculating Fluid in a Wall System," SN 10/457,103.

Zupanick, U.S. Pat. Appl., entitled "Wellbore Sealing System and Method," SN 10/406,037 Published.

Seams, U.S. Pat. Appl., entitled "Method and System for Extraction of Resources from a Subterranean Well Bore," SN 10/723,322.

Zupanick, U.S. Pat. Appl., entitled "Method and System for Accessing Subterranean Deposits from the Surface," SN 10/641,856.

Pratt, U.S. Pat. Appl., entitled "Method and System for Lining Multilateral Wells," SN —/——,——.

* cited by examiner

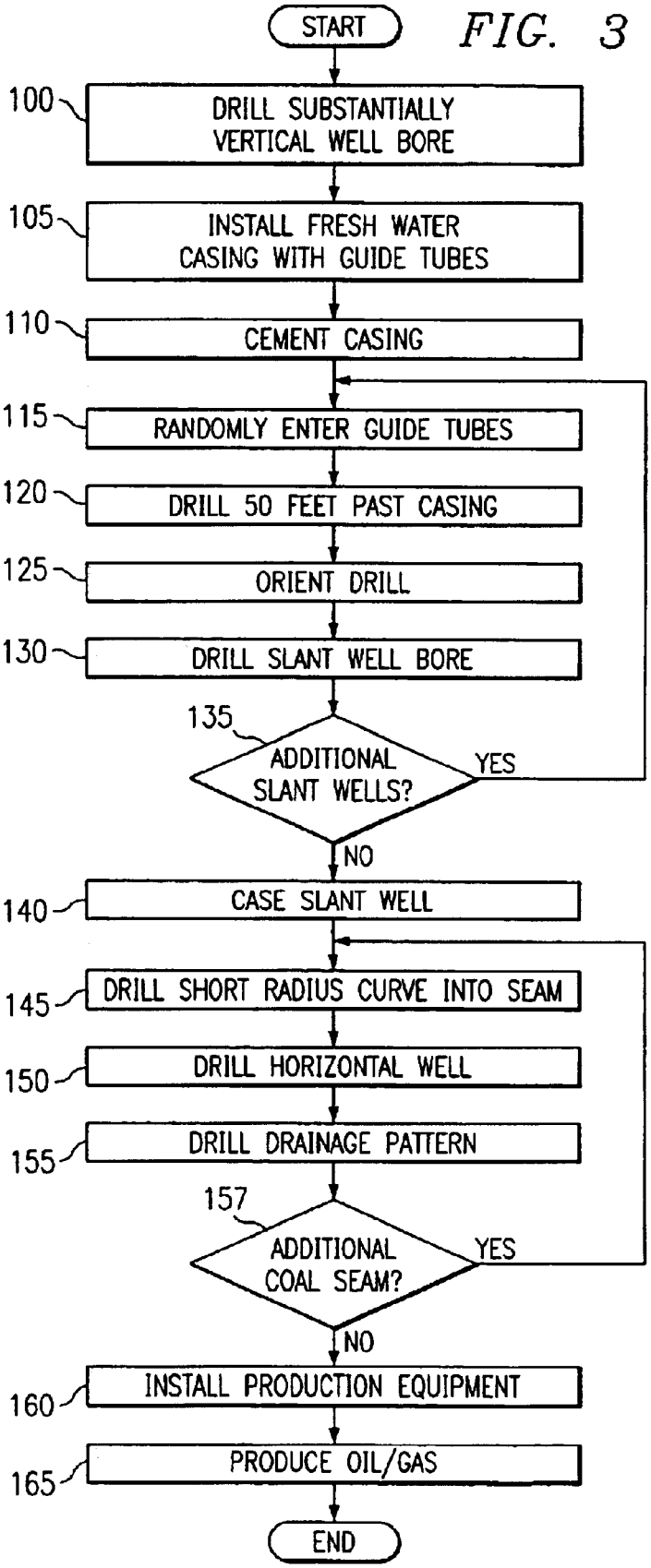
START
FIG. 3
100
DRILL SUBSTANTIALLY VERTICAL WELL BORE
105
INSTALL FRESH WATER CASING WITH GUIDE TUBES
110
CEMENT CASING
115
RANDOMLY ENTER GUIDE TUBES
120
DRILL 50 FEET PAST CASING
125
ORIENT DRILL
130
DRILL SLANT WELL BORE
135
ADDITIONAL SLANT WELLS?
YES
NO
140
CASE SLANT WELL
145
DRILL SHORT RADIUS CURVE INTO SEAM
150
DRILL HORIZONTAL WELL
155
DRILL DRAINAGE PATTERN
157
ADDITIONAL COAL SEAM?
YES
NO
160
INSTALL PRODUCTION EQUIPMENT
165
PRODUCE OIL/GAS
END

SLANT ENTRY WELL SYSTEM AND METHOD

CROSS-REFERENCE TO RELATED APPLICATION

This application is a divisional application of U.S. application Ser. No. 10/004,316 filed Oct. 30, 2001 and entitled "Slant Entry Well System and Method".

TECHNICAL FIELD OF THE INVENTION

The present invention relates generally to systems and methods for the recovery of subterranean resources and, more particularly, to a slant entry well system and method.

BACKGROUND OF THE INVENTION

Subterranean deposits of coal contain substantial quantities of entrained methane gas. Limited production and use of methane gas from coal deposits has occurred for many years. Substantial obstacles, however, have frustrated more extensive development and use of methane gas deposits in coal seams. The foremost problem in producing methane gas from coal seams is that while coal seams may extend over large areas of up to several thousand acres, the coal seams are fairly shallow in depth, varying from a few inches to several meters. Thus, while the coal seams are often relatively near the surface, vertical wells drilled into the coal deposits for obtaining methane gas can only drain a fairly small radius around the coal deposits. Further, coal deposits are not amenable to pressure fracturing and other methods often used for increasing methane gas production from rock formations. As a result, once the gas easily drained from a vertical well bore in a coal seam is produced, further production is limited in volume. Additionally, coal seams are often associated with subterranean water, which must be drained from the coal seam in order to produce the methane.

Horizontal drilling patterns have been tried in order to extend the amount of coal seams exposed to a drill bore for gas extraction. Such horizontal drilling techniques, however, require the use of a radiused well bore which presents difficulties in removing the entrained water from the coal seam. The most efficient method for pumping water from a subterranean well, a sucker rod pump, does not work well in horizontal or radiused bores.

As a result of these difficulties in surface production of methane gas from coal deposits, which must be removed from a coal seam prior to mining, subterranean methods have been employed. While the use of subterranean methods allows water to be easily removed from a coal seam and eliminates under-balanced drilling conditions, they can only access a limited amount of the coal seams exposed by current mining operations. Where longwall mining is practiced, for example, underground drilling rigs are used to drill horizontal holes from a panel currently being mined into an adjacent panel that will later be mined. The limitations of underground rigs limits the reach of such horizontal holes and thus the area that can be effectively drained. In addition, the degasification of a next panel during mining of a current panel limits the time for degasification. As a result, many horizontal bores must be drilled to remove the gas in a limited period of time. Furthermore, in conditions of high gas content or migration of gas through a coal seam, mining may need to be halted or delayed until a next panel can be adequately degasified. These production delays add to the expense associated with degasifying a coal seam.

SUMMARY OF THE INVENTION

The present invention provides a slant entry well system and method for accessing a subterranean zone from the surface that substantially eliminates or reduces the disadvantages and problems associated with previous systems and methods. In particular, certain embodiments of the present invention provide a slant entry well system and method for efficiently producing and removing entrained methane gas and water from a coal seam without requiring excessive use of radiused or articulated well bores or large surface area in which to conduct drilling operations.

In accordance with one embodiment of the present invention, a guide tube bundle includes two or more guide tubes. Each guide tube includes a first aperture at a first end and a second aperture at a second end. The longitudinal axis of the first aperture of each guide tube is offset from the longitudinal axis of the second aperture of the guide tube Furthermore, the guide tubes are configured longitudinally adjacent to each other and are twisted around one another.

Embodiments of the present invention may provide one or more technical advantages. These technical advantages may include the formation of a plurality of slanted well bores and drainage patterns to optimize the area of a subsurface formation which may be drained of gas and liquid resources. This allows for more efficient drilling and production and greatly reduces costs and problems associated with other systems and methods.

Another technical advantage includes providing a method for orienting well bores using a guide tube bundle inserted into an entry well bore. The guide tube bundle allows for the simple orientation of the slant well bores in relation to one another and optimizes the production of resources from subterranean zones by optimizing the spacing between the slanted well bores.

Other technical advantages of the present invention will be readily apparent to one skilled in the art from the following figures, descriptions, and claims.

BRIEF DESCRIPTION OF THE DRAWINGS

For a more complete understanding of the present invention and its advantages, reference is now made to the following description taken in conjunction with the accompanying drawings, wherein like numerals represent like parts, in which:

FIG. 3 illustrates an example method for producing water and gas from a subsurface formation;

DETAILED DESCRIPTION OF THE INVENTION

Figure 1:
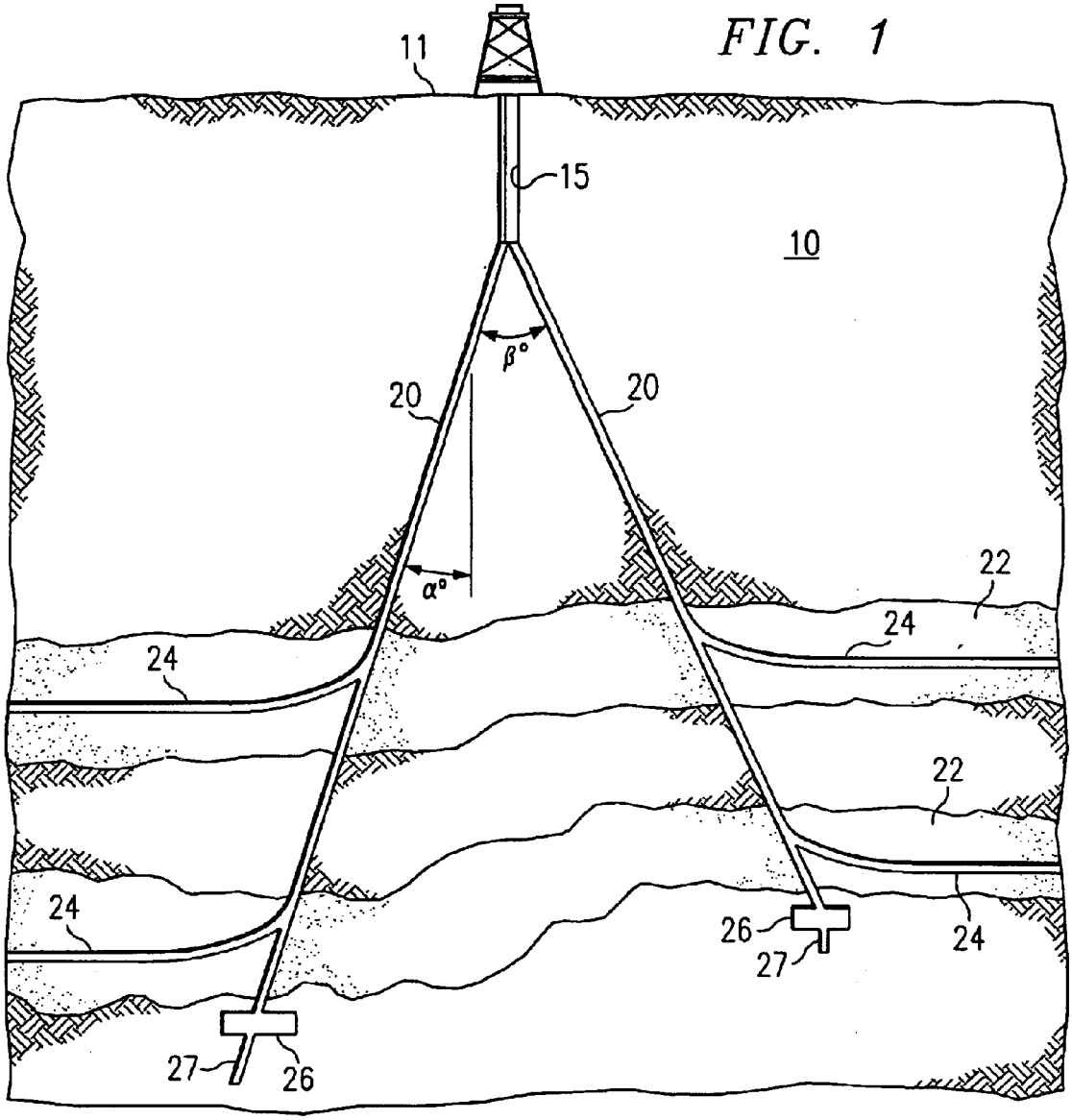
FIG. 1 illustrates an example slant well system for production of resources from a subterranean zone.

FIG. 1 illustrates an example slant well system for accessing a subterranean zone from the surface. In the embodiment described below, the subterranean zone is a coal seam. It will be understood that other subterranean formations and/or low pressure, ultra-low pressure, and low porosity subterranean zones can be similarly accessed using the slant well system of the present invention to remove and/or produce water, hydrocarbons and other fluids in the zone, to treat minerals in the zone prior to mining operations, or to inject or introduce fluids, gases, or other substances into the zone.

Referring to FIG. 1, a slant well system 10 includes an entry well bore 15, slant wells 20, articulated well bores 24, cavities 26, and rat holes 27. Entry well bore 15 extends from the surface 11 towards the subterranean zone 22. Slant wells 20 extend from the terminus of entry well bore 15 to the subterranean zone 22, although slant wells 20 may alternatively extend from any other suitable portion of entry well bore 15. Where there are multiple subterranean zones 22 at varying depths, as in the illustrated example, slant wells 20 extend through the subterranean zones 22 closest to the surface into and through the deepest subterranean zone 22. Articulated well bores 24 may extend from each slant well 20 into each subterranean zone 22. Cavity 26 and rat hole 27 are located at the terminus of each slant well 20.

In FIGS. 1, and, 5–8, entry well bore 15 is illustrated as being substantially vertical; however, it should be understood that entry well bore 15 may be formed at any suitable angle relative to the surface 11 to accommodate, for example, surface 11 geometries and attitudes and/or the geometric configuration or attitude of a subterranean resource. In the illustrated embodiment, slant well 20 is formed to angle away from entry well bore 15 at an angle designated alpha, which in the illustrated embodiment is approximately 20 degrees. It will be understood that slant well 20 may be formed at other angles to accommodate surface topologies and other factors similar to those affecting entry well bore 15. Slant wells 20 are formed in relation to each other at an angular separation of beta degrees, which in the illustrated embodiment is approximately sixty degrees. It will be understood that slant wells 20 may be separated by other angles depending likewise on the topology and geography of the area and location of the target coal seam 22.

Slant well 20 may also include a cavity 26 and/or a rat hole 27 located at the terminus of each slant well 20. Slant wells 20 may include one, both, or neither of cavity 26 and rat hole 27.

Figure 2A:
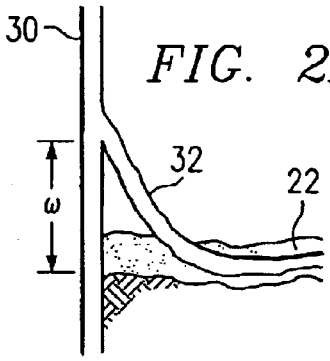
FIG. 2A illustrates a vertical well system for production of resources from a subterranean zone.
Figure 2B:
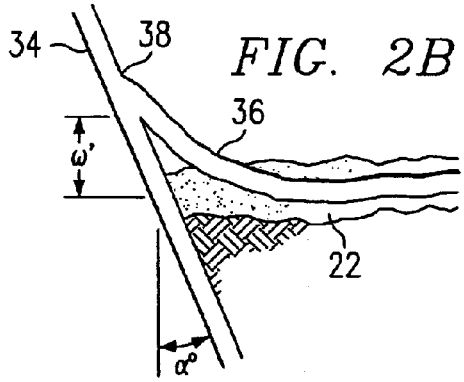
FIG. 2B illustrates a portion of An example slant entry well system in further detail.

FIGS. 2A and 2B illustrate by comparison the advantage of forming slant wells 20 at an angle. Referring to FIG. 2A, a vertical well bore 30 is shown with an articulated well bore 32 extending into a coal seam 22. As shown by the illustration, fluids drained from coal seam 22 into articulated well bore 32 must travel along articulated well bore 32 upwards towards vertical well bore 30, a distance of approximately W feet before they may be collected in vertical well bore 30. This distance of W feet is known as the hydrostatic head and must be overcome before the fluids may be collected from vertical well bore 30. Referring now to FIG. 2B, a slant entry well 34 is shown with an articulated well bore 36 extending into coal seam 22. Slant entry well 34 is shown at an angle alpha away from the vertical. As illustrated, fluids collected from coal seam 22 must travel along articulated well bore 36 up to slant entry well 34, a distance of W' feet. Thus, the hydrostatic head of a slant entry well system is reduced as compared to a substantially vertical system. Furthermore, by forming slant entry well 34 at angle alpha, the articulated well bore 36 drilled from tangent or kick off point 38 has a greater radius of curvature than articulated well bore 32 associated with vertical well bore 30. This allows for articulated well bore 36 to be longer than articulated well bore 32 (since the friction of a drill string against the radius portion is reduced), thereby penetrating further into coal seam 22 and draining more of the subterranean zone.

FIG. 3 illustrates an example method of forming a slant entry well. The steps of FIG. 3 will be further illustrated in subsequent FIGS. 4–11. The method begins at step 100 where the entry well bore is formed. At step 105, a fresh water casing or other suitable casing with an attached guide tube bundle is installed into the entry well bore formed at step 100. At step 110, the fresh water casing is cemented in place inside the entry well bore of step 100.

At step 115, a drill string is inserted through the entry well bore and one of the guide tubes in the guide tube bundle. At step 120, the drill string is used to drill approximately fifty feet past the casing. At step 125, the drill is oriented to the desired angle of the slant well and, at step 130, a slant well bore is drilled down into and through the target subterranean zone.

At decisional step 135, a determination is made whether additional slant wells are required. If additional slant wells are required, the process returns to step 115 and repeats through step 135. Various means may be employed to guide the drill string into a different guide tube on subsequent runs through steps 115–135, which should be apparent to those skilled in the art.

If no additional slant wells are required, the process continues to step 140. At step 140 the slant well casing is installed. Next, at step 145, a short radius curve is drilled into the target coal seam. Next, at step 150, a substantially horizontal well bore is drilled into and along the coal seam. It will be understood that the substantially horizontal well bore may depart from a horizontal orientation to account for changes in the orientation of the coal seam. Next, at step 155, a drainage pattern is drilled into the coal seam through the substantially horizontal well. At decisional step 157, a determination is made whether additional subterranean zones are to be drained as, for example, when multiple subterranean zones are present at varying depths below the surface. If additional subterranean zones are to be drained, the process repeats steps 145 through 155 for each additional subterranean zone. If no further subterranean zones are to be drained, the process continues to step 160.

At step 160, production equipment is installed into the slant well and at step 165 the process ends with the production of water and gas from the subterranean zone.

Although the steps have been described in a certain order, it will be understood that they may be performed in any other appropriate order. Furthermore, one or more steps may be omitted, or additional steps performed, as appropriate.

Figure 4A:
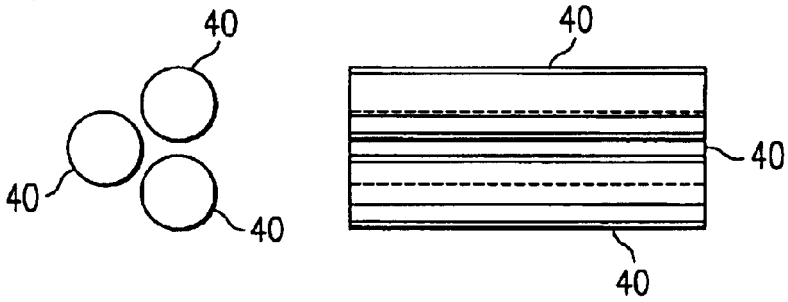
FIGS. 4A–4C illustrate construction of an example guide tube bundle.
Figure 4B:
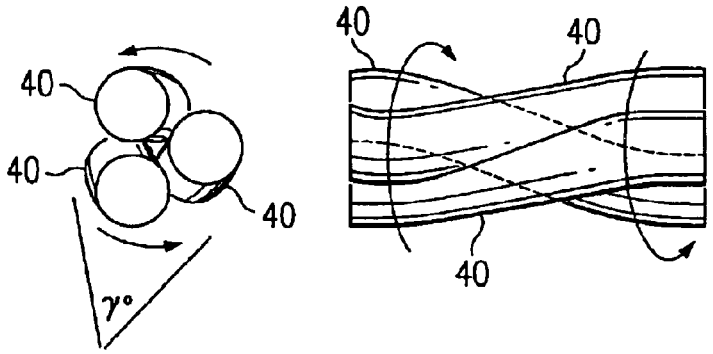
Figure 4C:
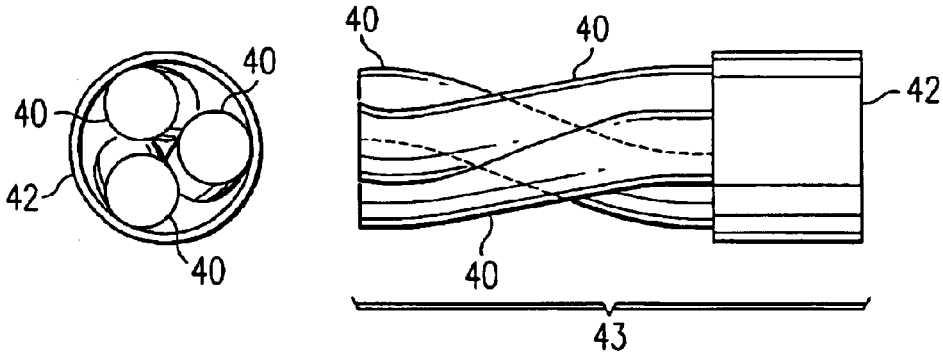

FIGS. 4A, 4B, and 4C illustrate formation of a casing with associated guide tube bundle as described in step 105 of FIG. 3. Referring to FIG. 4A, three guide tubes 40 are shown in side view and end view. The guide tubes 40 are arranged so that they are parallel to one another. In the illustrated embodiment, guide tubes 40 are 9⅝" joint casings. It will be understood that other suitable materials may be employed.

FIG. 4B illustrates a twist incorporated into guide tubes 40. The guide tubes 40 are twisted gamma degrees in relation to one another while maintaining the lateral arrangement to gamma degrees. Guide tubes 40 are then welded or otherwise stabilized in place. In an example embodiment, gamma is equal to 10 degrees.

FIG. 4C illustrates guide tubes 40, incorporating the twist, in communication and attached to a casing collar 42. The guide tubes 40 and casing collar 42 together make up the guide tube bundle 43, which may be attached to a fresh water or other casing sized to fit the length of entry well bore 15 of FIG. 1 or otherwise suitably configured.

Figure 5:
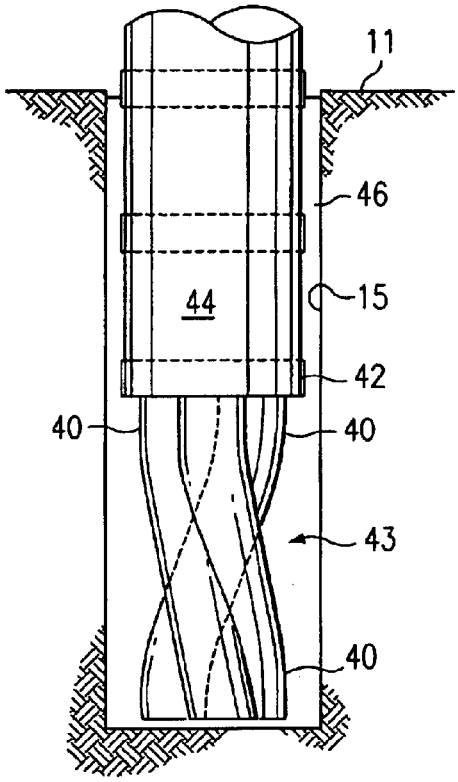
FIG. 5 illustrates an example entry well bore with an installed guide tube bundle.

FIG. 5 illustrates entry well bore 15 with guide tube bundle 43 and casing 44 installed in entry well bore 15. Entry well bore 15 is formed from the surface 11 to a target depth of approximately three hundred and ninety feet. Entry well bore 15, as illustrated, has a diameter of approximately twenty-four inches. Forming entry well bore 15 corresponds with step 100 of FIG. 3. Guide tube bundle 43 (consisting of joint casings 40 and casing collar 42) is shown attached to a casing 44. Casing 44 may be any fresh water casing or other casing suitable for use in down-hole operations. Inserting casing 44 and guide tube bundle 43 into entry well bore 15 corresponds with step 105 of FIG. 3.

Corresponding with step 110 of FIG. 3, a cement retainer 46 is poured or otherwise installed around the casing inside entry well bore 15. The cement casing may be any mixture or substance otherwise suitable to maintain casing 44 in the desired position with respect to entry well bore 15.

Figure 6:
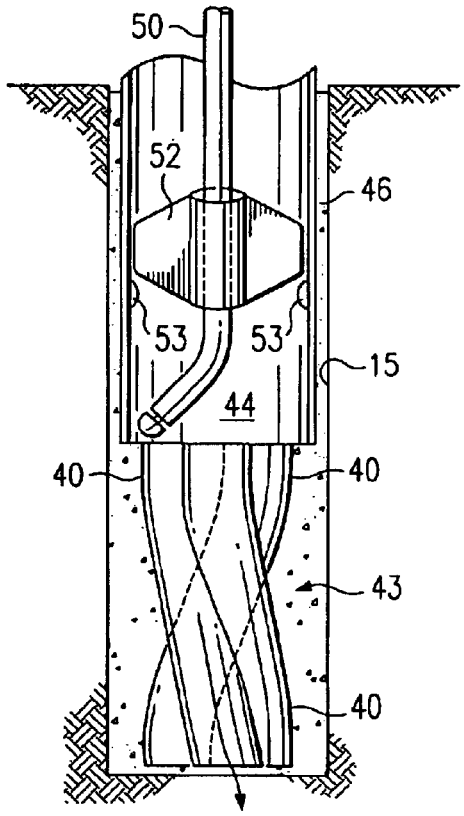
FIG. 6 illustrates the use of an example guide tube bundle in an entry well bore.

FIG. 6 illustrates entry well bore 15 and casing 44 with guide tube 43 in its operative mode as slant wells 20 are about to be drilled. A drill string 50 is positioned to enter one of the guide tubes 40 of guide tube bundle 43. In order to keep drill string 50 relatively centered in casing 44, a stabilizer 52 may be employed. Stabilizer 52 may be a ring and fin type stabilizer or any other stabilizer suitable to keep drill string 50 relatively centered. To keep stabilizer 52 at a desired depth in well bore 15, stop ring 53 may be employed. Stop ring 53 may be constructed of rubber or metal or any other foreign down-hole environment material suitable. Drill string 50 may be inserted randomly into any of a plurality of guide tubes 40 of guide tube bundle 43, or drill string 50 may be directed into a selected joint casing 40. This corresponds to step 115 of FIG. 3.

Figure 7:
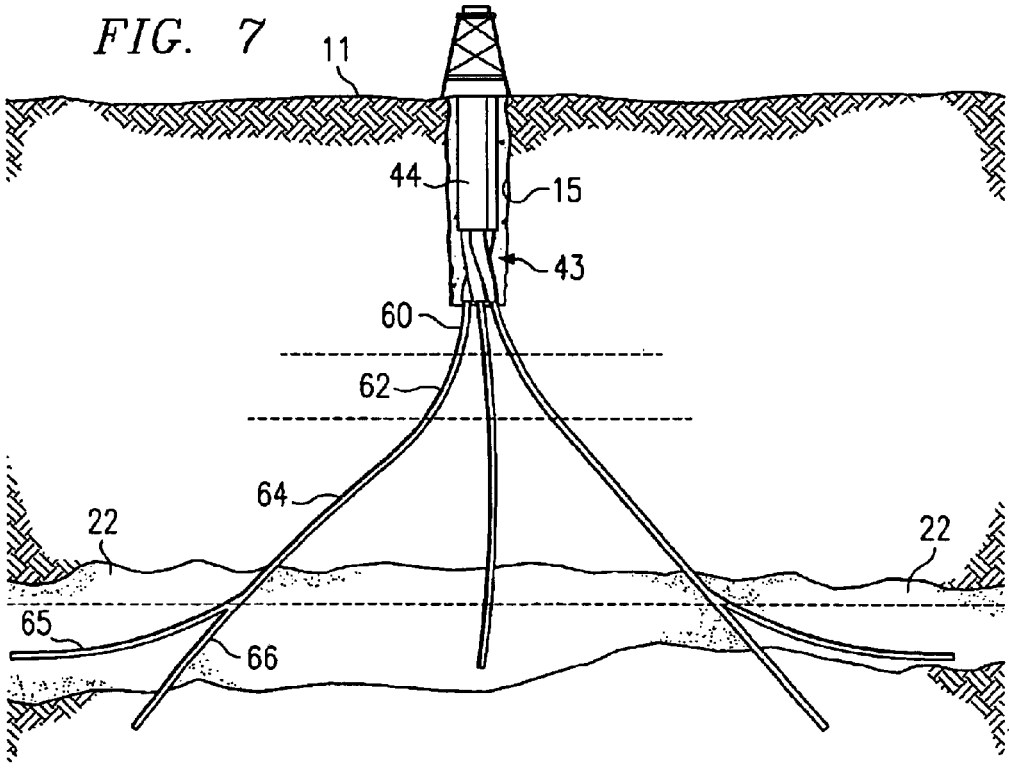
FIG. 7 illustrates an example system of slanted well bores.

FIG. 7 illustrates an example system of slant wells 20. Corresponding with step 120 of FIG. 3, tangent well bore 60 is drilled approximately fifty feet past the end of entry well bore 15 (although any other appropriate distance may be drilled). Tangent well bore 60 is drilled away from casing 44 in order to minimize magnetic interference and improve the ability of the drilling crew to guide the drill bit in the desired direction. Corresponding with step 125 of FIG. 3, a radiused well bore 62 is drilled to orient the drill bit in preparation for drilling the slant entry well bore 64. In a particular embodiment, radiused well bore 62 is curved approximately twelve degrees per one hundred feet (although any other appropriate curvature may be employed).

Corresponding with step 130 of FIG. 3, a slant entry well bore 64 is drilled from the end of the radius well bore 62 into and through the subterranean zone 22. Alternatively, slant well 20 may be drilled directly from guide tube 40, without including tangent well bore 60 or radiused well bore 62. An articulated well bore 65 is shown in its prospective position but is drilled later in time than rat hole 66, which is an extension of slant well 64. Rat hole 66 may also be an enlarged diameter cavity or other suitable structure. After slant entry well bore 64 and rat hole 66 are drilled, any additional desired slant wells are then drilled before proceeding to installing casing in the slant well.

Figure 8:
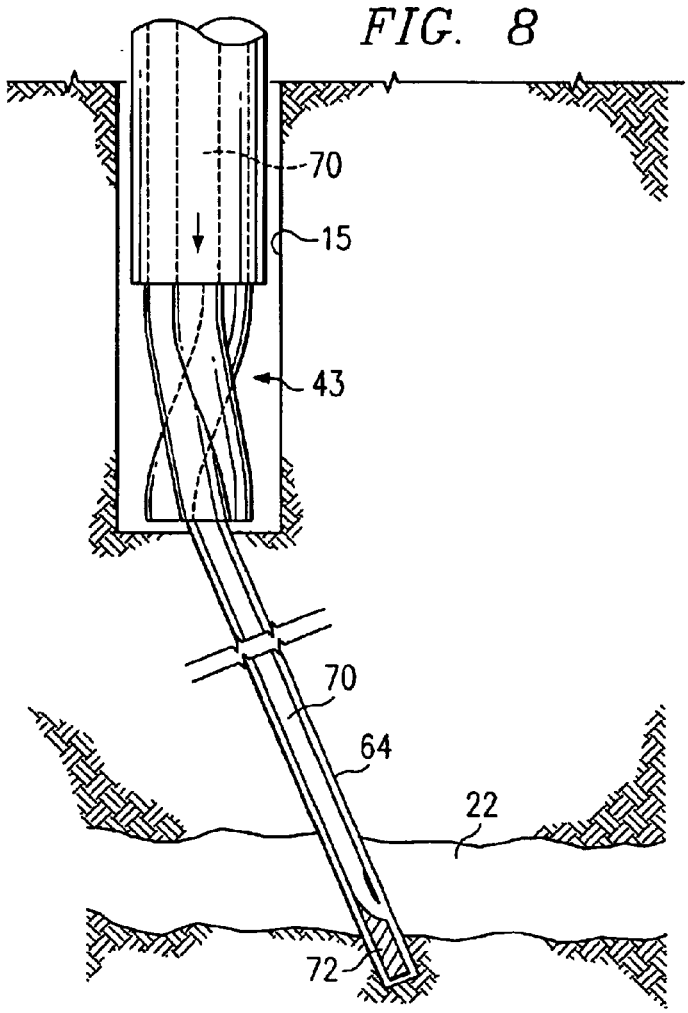
FIG. 8 illustrates an example system of an entry well bore and a slanted well bore.

FIG. 8 is an illustration of the casing of a slant well 64. For ease of illustration, only one slant well 64 is shown. Corresponding with step 140 of FIG. 3, a whip stock casing 70 is installed into the slant entry well bore 64. In the illustrated embodiment, whip stock casing 70 includes a whip stock 72 which is used to mechanically direct a drill string into a desired orientation. It will be understood that other suitable casings may be employed and the use of a whip stock 72 is not necessary when other suitable methods of orienting a drill bit through slant well 64 into the subterranean zone 22 are used.

Casing 70 is inserted into the entry well bore 15 through guide tube bundle 43 and into slant entry well bore 64. Whip stock casing 70 is oriented such that whip stock 72 is positioned so that a subsequent drill bit is aligned to drill into the subterranean zone 22 at the desired depth.

Figure 9:
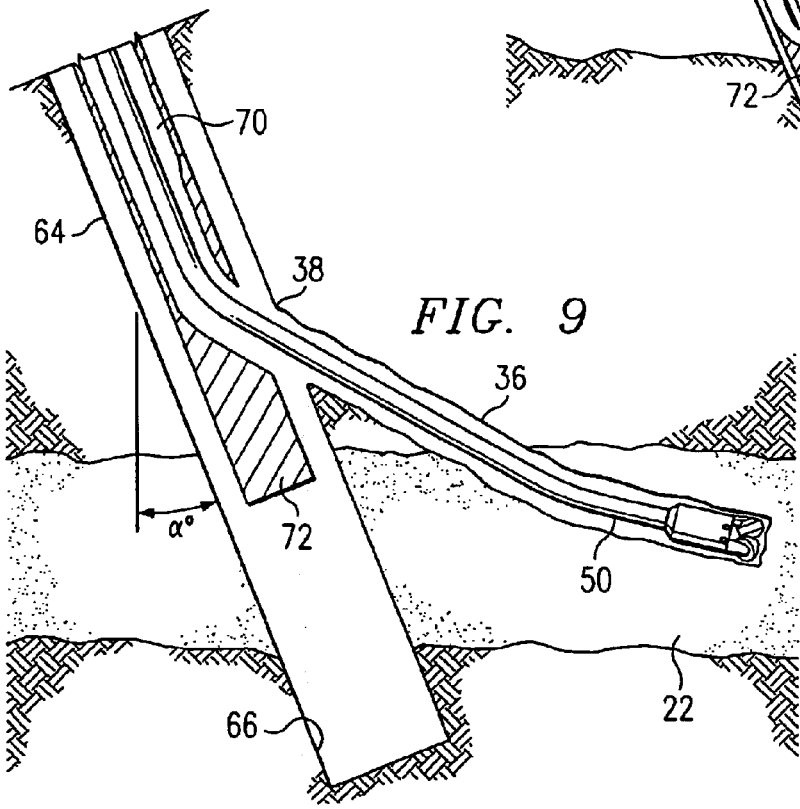
FIG. 9 illustrates an example system of a slanted well bore and an articulated well bore.

FIG. 9 illustrates whip stock casing 70 and slant entry well bore 64. As discussed in conjunction with FIG. 8, whip stock casing 70 is positioned within slant entry well bore 64 such that a drill string 50 will be oriented to pass through slant entry well bore 64 at a desired tangent or kick off point 38. This corresponds with step 145 of FIG. 3. Drill string 50 is used to drill through slant entry well bore 64 at tangent or kick off point 38 to form articulated well bore 36. In a particular embodiment, articulated well bore 36 has a radius of approximately seventy-one feet and a curvature of approximately eighty degrees per one hundred feet. In the same embodiment, slant entry well 64 is angled away from the vertical at approximately ten degrees. In this embodiment, the hydrostatic head generated in conjunction with production is roughly thirty feet. However, it should be understood that any other appropriate radius, curvature, and slant angle may be used.

Figure 10:
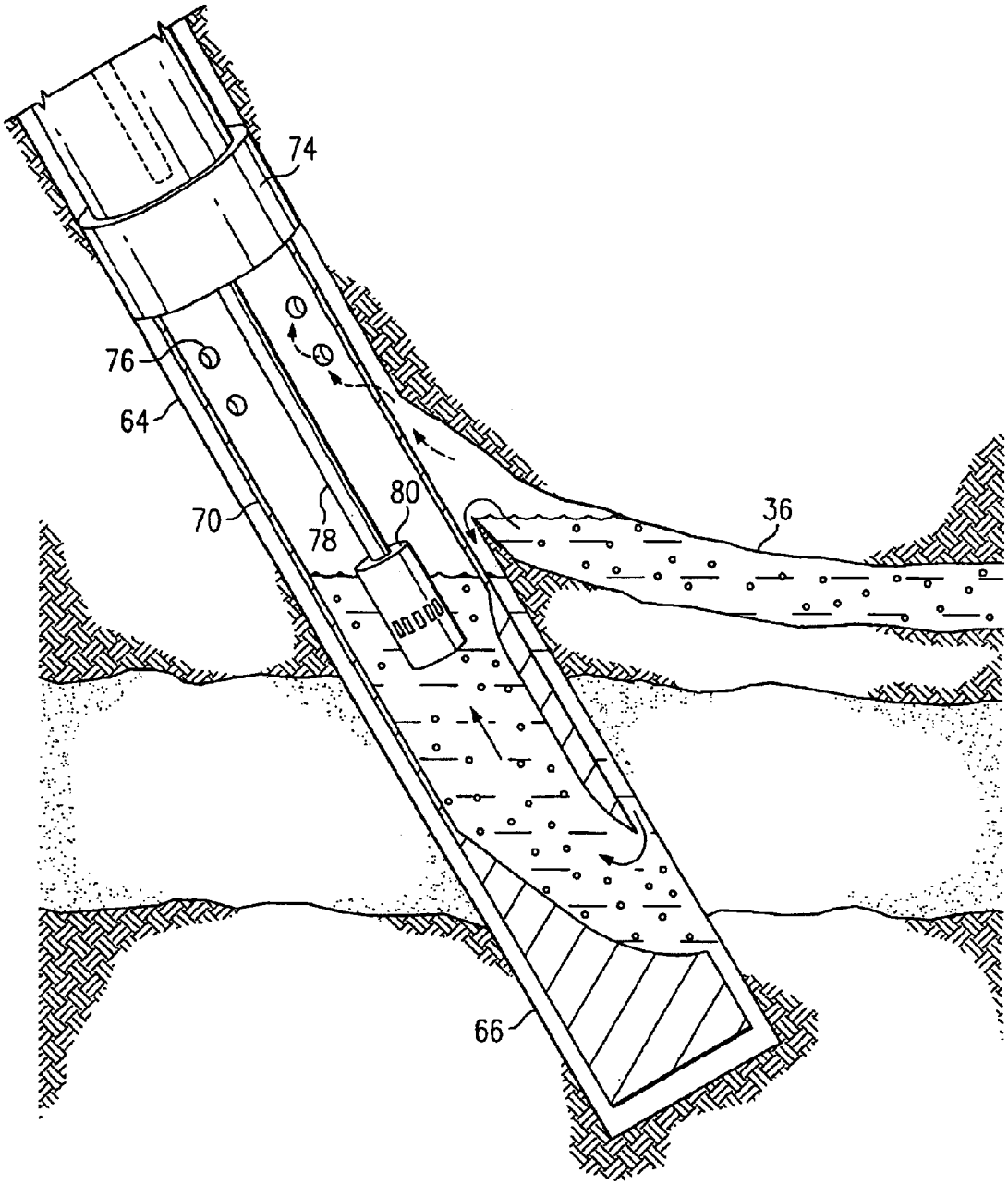
FIG. 10 illustrates production of water and gas in an example slant well system.

FIG. 10 illustrates a slant entry well 64 and articulated well bore 36 after drill string 50 has been used to form articulated well bore 36. In a particular embodiment, a horizontal well and drainage pattern may then be formed in subterranean zone 22, as represented by step 150 and step 155 of FIG. 3.

Referring to FIG. 10, whip stock casing 70 is set on the bottom of rat hole 66 to prepare for production of oil and gas. A sealer ring 74 may be used around the whip stock casing 70 to prevent gas produced from articulated well bore 36 from escaping outside whip stock casing 70. Gas ports 76 allow escaping gas to enter into and up through whip stock casing 70 for collection at the surface.

A pump string 78 and submersible pump 80 is used to remove water and other liquids that are collected from the subterranean zone through articulated well bore 36. As shown in FIG. 10, the liquids, under the power of gravity and the pressure in subterranean zone 22, pass through articulated well bore 36 and down slant entry well bore 64 into rat hole 66. From there the liquids travel into the opening in the whip stock 72 of whip stock casing 70 where they come in contact with the installed pump string 78 and submersible pump 80. Submersible pump 80 may be a variety of submersible pumps suitable for use in a down-hole environment to remove liquids and pump them to the surface through pump string 78. Installation of pump string 78 and submersible pump 80 corresponds with step 160 of FIG. 3. Production of liquid and gas corresponds with step 165 of FIG. 3.

Figure 11:
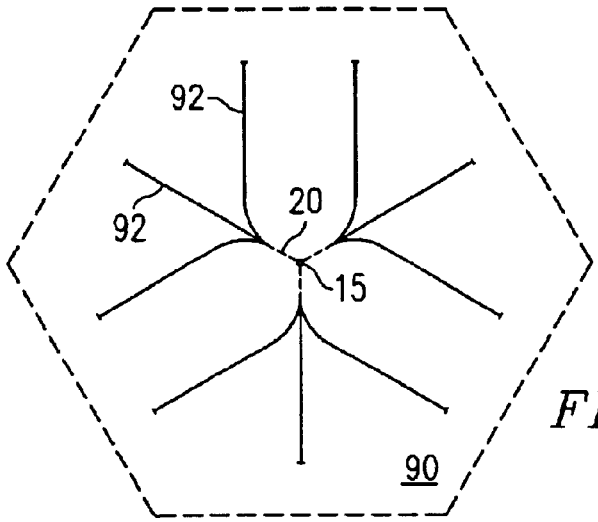
FIG. 11 illustrates an example drainage pattern for use with a slant well system.
Figure 12:
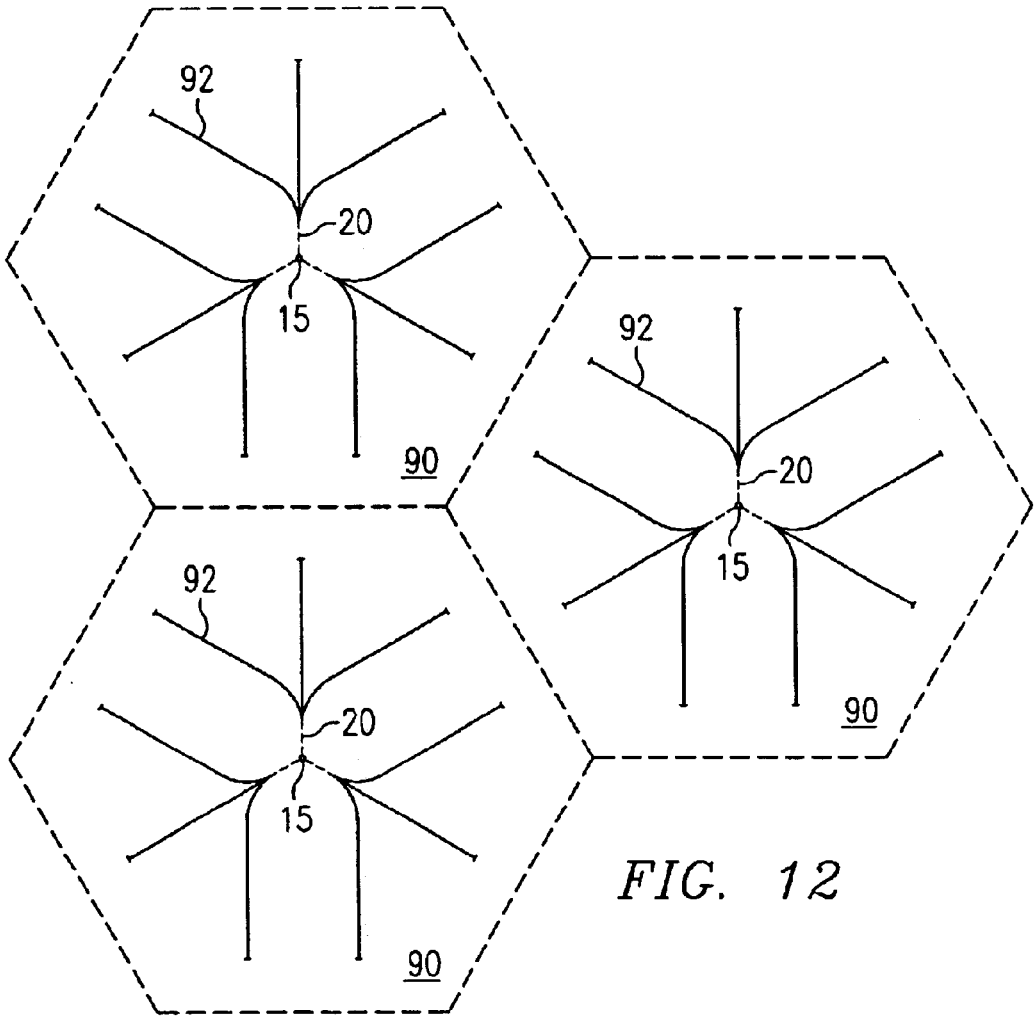
FIG. 12 illustrates an example alignment of drainage patterns for use with a slant well system.

FIG. 11 illustrates an example drainage pattern 90 that may be drilled from articulated well bores 36. At the center of drainage pattern 90 is entry well bore 15. Connecting to entry well bore 15 are slant wells 20. At the terminus of slant well 20, as described above, are substantially horizontal well bores 92 roughly forming a "crow's foot" pattern off of each of the slant wells 20. As used throughout this application, "each" means all of a particular subset. In a particular embodiment, the horizontal reach of each substantially horizontal well bore 92 is approximately fifteen hundred feet. Additionally, the lateral spacing between the parallel substantially horizontal well bores 92 is approximately eight hundred feet. In this particular embodiment, a drainage area of approximately two hundred and ninety acres would result. In an alternative embodiment where the horizontal reach of the substantially horizontal well bore 92 is approximately two thousand four hundred and forty feet, the drainage area would expand to approximately six hundred and forty acres. However, any other suitable configurations may be used. Furthermore, any other suitable drainage patterns may be used.

FIG. 13 illustrates a plurality of drainage patterns 90 in relationship to one another to maximize the drainage area of a subsurface formation covered by the drainage patterns 90. Each drainage pattern 90 forms a roughly hexagonal drainage pattern. Accordingly, drainage patterns 90 may be aligned, as illustrated, so that the drainage patterns 90 form a roughly honeycomb-type alignment.

Although the present invention has been described with several embodiments, various changes and modifications may be suggested to one skilled in the art. It is intended that the present invention encompass such changes and modifications as fall within the scope of the appended claims.

What is claimed is:

1. A guide tube bundle, comprising:

two or more guide tubes;

wherein the two or more guide tubes each comprise a first aperture at a first end and a second aperture at a second end;

wherein the guide tubes are configured longitudinally adjacent to each other;

wherein the longitudinal axis of the first aperture of each guide tube is offset from the longitudinal axis of the second aperture of the guide tube; and wherein the guide tubes are twisted around one another.

2. The guide tube bundle of claim 1, wherein the angle at which the guide tubes are twisted comprises approximately ten degrees.

3. The guide tube bundle of claim 1, wherein:

the guide tubes are configured longitudinally adjacent to each other at their first ends; and the guide tubes are separated at their second ends.

4. A method for orienting well bores, comprising:

forming an entry well bore from the surface;

inserting a guide tube bundle into the entry well bore, the guide tube bundle comprising:

two or more guide tubes, wherein:

the two or more guide tubes each comprise a first aperture at a first end and a second aperture at a second end;

the guide tubes are configured longitudinally adjacent to each other; and the guide tubes are twisted around one another; and the longitudinal axis of the first aperture of each guide tube is offset from the longitudinal axis of the second aperture of the guide tube; and forming two or more slanted well bores from the entry well bore using the guide tube bundle.

5. The method of claim 4, wherein:

the longitudinal axis of the first aperture of each guide tube is oriented vertically; and the longitudinal axis of the second aperture of each guide tube is oriented at an angle offset from the longitudinal axis of the first aperture.

6. The method of claim 4, wherein the angle at which the guide tubes are twisted comprises approximately ten degrees.

7. The method of claim 4, wherein:

the guide tubes are configured longitudinally adjacent to each other at their first ends; and the guide tubes are separated at their second ends.

* * * * *